US009579783B2

(12) United States Patent
Wirnitzer et al.

(10) Patent No.: US 9,579,783 B2
(45) Date of Patent: Feb. 28, 2017

(54) POWER TOOL HAVING IMPROVED OPERABILITY

(71) Applicant: Robert Bosch GmbH, Stuttgart (DE)

(72) Inventors: Bernd Wirnitzer, Friolzheim (DE); Christoph Steurer, Urbach (DE)

(73) Assignee: ROBERT BOSCH GMBH, Stuttgart (DE)

( * ) Notice: Subject to any disclaimer, the term of this patent is extended or adjusted under 35 U.S.C. 154(b) by 534 days.

(21) Appl. No.: 14/152,226

(22) Filed: Jan. 10, 2014

(65) Prior Publication Data

US 2014/0196920 A1 Jul. 17, 2014

(30) Foreign Application Priority Data

Jan. 16, 2013 (DE) ..... 10 2013 200 602

(51) Int. Cl.
*B25B 21/02* (2006.01)
*E21B 7/00* (2006.01)
*B25F 5/00* (2006.01)

(52) U.S. Cl.
CPC ..... *B25F 5/00* (2013.01)

(58) Field of Classification Search
CPC . B25B 21/00; B25F 5/00; B25F 5/001; B25D 17/00; B25D 16/00; B25D 2216/0069; B25D 2250/221; B23Q 17/2233; B23Q 17/2428; B23Q 5/10
USPC ..... 173/1–2
See application file for complete search history.

(56) References Cited

U.S. PATENT DOCUMENTS 5,476,014 A * 12/1995 Lampe ..... B25B 23/14 73/862.21
5,914,882 A * 6/1999 Yeghiazarians ..... F16P 3/00 408/1 R
6,311,786 B1 * 11/2001 Giardino ..... B25B 23/1405 173/1
6,490,930 B1 * 12/2002 Ohkubo ..... B24B 23/00 73/570
8,479,963 B2 * 7/2013 Kitagawa ..... B25C 1/041 227/130
2002/0020538 A1 * 2/2002 Giardino ..... B25B 23/1405 173/176
2003/0006051 A1 * 1/2003 Schmitzer ..... B25D 17/043 173/49
2004/0011632 A1 * 1/2004 Hellmann ..... B25F 5/00 200/179
2004/0134686 A1 * 7/2004 Burrows ..... E21B 7/046 175/45
2004/0211573 A1 * 10/2004 Carrier ..... B25F 5/00 173/2
2005/0161241 A1 * 7/2005 Frauhammer ..... B25F 5/026 173/1

(Continued)

FOREIGN PATENT DOCUMENTS

DE 101 03 142 7/2002

*Primary Examiner* — Robert Long
(74) *Attorney, Agent, or Firm* — Gerard Messina

(57) ABSTRACT

A power tool includes: a drive unit for a tool; an operating device for activating the power tool; a measuring device for measuring a motion of the power tool; and a filter for filtering at least one measured value of the measured motion. The operating device is configured to reduce a power output of the drive unit when the filtered, measured value corresponds to a state of reduced ease of operation.

12 Claims, 2 Drawing Sheets

(56) References Cited

U.S. PATENT DOCUMENTS

| | | | | |
|---|---|---|---|---|
| 2006/0185869 | A1* | 8/2006 | Arimura | B25B 23/1475 173/176 |
| 2007/0035311 | A1* | 2/2007 | Wuersch | B23B 49/006 324/644 |
| 2008/0163504 | A1* | 7/2008 | Smith | G01C 21/20 33/268 |
| 2008/0190988 | A1* | 8/2008 | Pedicini | B25C 1/04 227/130 |
| 2009/0236387 | A1* | 9/2009 | Simonelli | B25C 1/008 227/8 |
| 2010/0001017 | A1* | 1/2010 | Herman | B05C 17/0103 222/1 |
| 2011/0114345 | A1* | 5/2011 | Schlesak | B23Q 11/0092 173/1 |
| 2012/0279742 | A1* | 11/2012 | Roser | B25F 5/00 173/176 |
| 2013/0300333 | A1* | 11/2013 | Sako | B25F 5/00 318/490 |
| 2014/0216773 | A1* | 8/2014 | Steurer | B23Q 11/0092 173/1 |
| 2015/0158170 | A1* | 6/2015 | Nitsche | B25D 17/24 173/1 |
| 2015/0375147 | A1* | 12/2015 | Cai | C02F 1/003 340/540 |
| 2016/0049817 | A1* | 2/2016 | Karlsson | B25F 5/00 173/1 |
| 2016/0286111 | A1* | 9/2016 | Suwa | G03B 17/561 |

* cited by examiner

POWER TOOL HAVING IMPROVED OPERABILITY

BACKGROUND OF THE INVENTION

1. Field of the Invention

The present invention relates to a power tool and a method for operating a power tool.

2. Description of the Related Art

In the related art, it is known, for example, from Published German patent application document DE 101 03 142 A1, that a starting safety routine against instances of locking-up during starting may be provided, in which for a brief period of time, an electric motor is connected to the power supply system via a determinable resistance and a limiting value and/or the switch-off time for a safety routine against tool jamming is set by measuring the angle of rotation of the rotor over the period of time as a function of the start-up behavior of a rotor during the period of time.

BRIEF SUMMARY OF THE INVENTION

An object of the present invention is to increase the ease of operation of a power tool for a user.

The described power tool and the described method have the advantage that an unchecked angular motion of the power tool, which reduces the ease of operation for the user, is safely and reliably detected. This is achieved by providing a filter, which filters at least one measured value of the detected motion; and the power output of the drive unit, that is, the torque and/or the rotational speed, are reduced, and/or the drive unit is switched off, and/or the drive unit is decelerated, when the filtered, measured value reaches and/or exceeds and/or falls below a limiting value.

In one specific embodiment, a low-pass filter and/or a high-pass filter is provided as a filter. With the aid of the low-pass filter and/or the high-pass filter, the measuring signal may be accurately acquired. For example, values of 125 Hz or 250 Hz may be used as a cutoff frequency for the low-pass filter. Filters, which have a cutoff frequency of, e.g., 0.5 Hz or 1 Hz, may be used as high-pass filters. The acquired measuring signal may be separated from interfering portions of the signal through the use of the low-pass filter and/or the high-pass filter. Consequently, the measuring signal may be evaluated more accurately.

In a further specific embodiment, the characteristic of the filter is a function of the type of storage battery, in particular, a function of the weight of the storage battery used. Power tools may be driven by different storage batteries. In this context, storage batteries having different weights may be used. Consequently, the storage batteries having different weights have an influence on the vibration response of the power tool. Thus, consideration of the weight of the storage battery provides improved evaluation of the measuring signal, which means that interference signals may be filtered out more effectively.

For example, the type of storage battery may be detected automatically by the power tool or input by an operator via an input device, such as a switch or a selector lever. In one further specific embodiment, the power tool has an acceleration sensor and/or a rotation-rate sensor; the measuring signal of the acceleration sensor and the measuring signal of the rotation-rate sensor being able to be filtered using different filter characteristics. An increased and improved accuracy regarding the type of motion of the power tool is possible through the use of the acceleration sensor and the rotation-rate sensor. The acceleration sensor and the rotation-rate sensor supply different measuring signals, which means that individual filtering of the different measuring signals renders improved signal evaluation possible.

In a further specific embodiment, the filtered measuring signal of the acceleration sensor and/or the filtered measuring signal of the rotation-rate sensor are integrated with respect to time and used for detecting an unchecked angular motion or similar reduction in comfort. A further piece of information about the type of motion of the power tool is obtained by integrating the measuring signal. Consequently, the motion of the power tool may be analyzed more effectively with regard to ease of operation for the operator.

In particular, improved detection of a reduction in the ease of operation is achieved, when both the measuring signal of the acceleration sensor and the measuring signal of the rotation-rate sensor are used for detecting a motion of the power tool. For that purpose, e.g., different comparison values, threshold values or time characteristics of the comparison values or threshold values for the measuring signal of the acceleration sensor and the measuring signal of the rotation-rate sensor are stored for detecting a motion of the power tool and/or an unchecked angular motion or similar reduction in ease of operation. For example, a reduction in the ease of operation is only detected, when the measuring signal of the acceleration sensor and the integrated measuring signal of the acceleration sensor and the measuring signal of the rotation-rate sensor and the integrated measuring signal of the rotation-rate sensor satisfy specified values. Therefore, a reduction in the ease of operation is detected with a high level of precision.

In one further specific embodiment, in order to detect a reduction in the ease of operation, a measuring signal is acquired by the acceleration sensor in at least two moving directions pointing perpendicular to one another and is used for detecting a state of reduced ease of operation. Consequently, it is possible to measure the motion of the power tool more precisely.

DETAILED DESCRIPTION OF THE INVENTION

Figure 1:
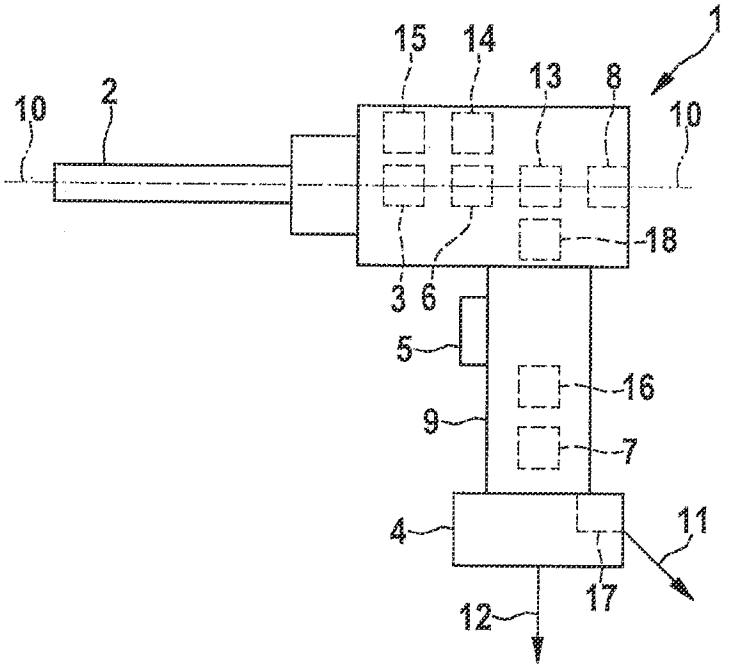
FIG. 1 is a schematic representation of a side view of a power tool.

In a schematic representation, FIG. 1 shows a power tool 1, which, in the exemplary embodiment shown, takes the form of a drill or screwdriver. However, power tool 1 may also be implemented in other specific embodiments, such as an angle grinder or a chain saw. Power tool 1 includes a drill as a tool 2. In addition, an electrical drive unit 3 is provided, which is mechanically linked to tool 2. Drive unit 3 may be mechanically linked to tool 2 directly or via a transmission. Drive unit 3 is connected to a storage battery 4, the storage battery 4 supplying drive unit 3 with electrical energy. In place of storage battery 4, power tool 1 may also be supplied with current via a cable.

Power tool 1 also has a switch 5 as an operating device, through the manipulation of which the drive unit 3 may be switched on or off. In addition, a control unit 6 is provided, which detects the switching position of switch 5 and correspondingly controls drive unit 3 as a function of the switching position of switch 5. Furthermore, control unit 6 is connected to an acceleration sensor 7. Acceleration sensor 7 is situated in a handle 9, set apart as far as possible from an axis of rotation 10 of tool 2. Axis of rotation 10 runs along the longitudinal axis of drill 2. In addition, a rotation-rate sensor 8 is provided, which is also connected to control unit 6. Rotation-rate sensor 8 measures a rotation of power tool 1 as a measuring signal and passes it along to control unit 6. Depending on the specific embodiment selected, only an acceleration sensor or only a rotation-rate sensor may be provided. In addition, in a further specific embodiment, a rotation-rate sensor and an acceleration sensor may be provided. Furthermore, a plurality of acceleration sensors and/or rotation-rate sensors may be provided.

Acceleration sensor 7 is configured to measure an acceleration along an x-axis 11 and/or along a z-axis 12. X-axis 11 and z-axis 12 are perpendicular to one another and are represented schematically in FIG. 1 in the form of arrows. In addition, a filter 13 is provided, which filters the measuring signals of acceleration sensor 7 and/or the measuring signals of rotation-rate sensor 8, using a defined filter characteristic. For example, filter 13 may be configured as a low-pass filter and/or as a high-pass filter. The low-pass filter may have, for example, a cutoff frequency of 125 Hz or 250 Hz; the low-pass filter retransmitting the frequency of a measuring signal below the cutoff frequency essentially unchanged and lopping off the frequency of a measuring signal above the cutoff frequency. In the specific embodiment as a high-pass filter, filter 13 may have a cutoff frequency of, for example, 0.5 Hz or 1 Hz. The high-pass filter retransmits the measuring signal in the range above the cutoff frequency essentially unchanged and lops off the measuring signal below the cutoff frequency. Depending on the specific embodiment selected, filter 13 may carry out both the high-pass filtering and the low-pass filtering. In addition, values different from the exemplarily mentioned values for the cutoff frequencies of the high-pass filter and/or the low-pass filter may be used, in which case the cutoff frequencies define the filter characteristic.

Furthermore, an integration unit 18 may be provided, which integrates the measuring signals of acceleration sensor 7 and/or of rotation-rate sensor 8 with respect to time after the filtering and passes these integrated measuring signals along to control unit 6.

Figure 2:
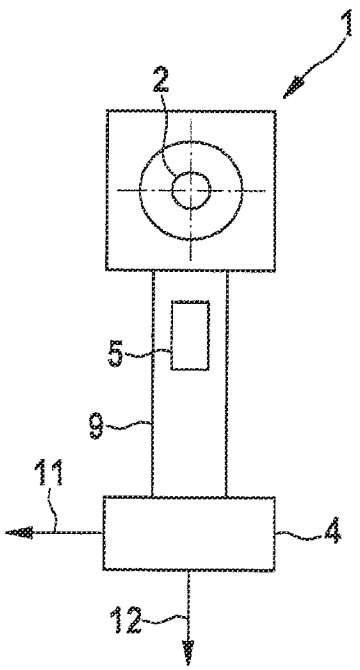
FIG. 2 is a schematic representation of a front view of a power tool.

In a schematic front view, FIG. 2 shows power tool 1, where x-axis 11 and z-axis 12 are situated at right angles to one another.

Acceleration sensor 7 is configured to measure the acceleration of power tool 1 along x-axis 11 and/or along z-axis 12. The measuring signals separated for the two axes 11, 12 are transmitted separately to control unit 6 via filter 13. Acceleration sensor 7 is preferably situated as far a distance as possible from axis of rotation 10. This provides sufficient separation of the useful signal in comparison with gravitational acceleration, which means that in comparison with the acceleration values of interest, gravitational acceleration may be disregarded. Consequently, an exact determination of and compensation for gravitational acceleration, e.g., by a high-pass filter, may be omitted.

The acceleration measured by the acceleration sensor results from the distance of acceleration sensor 7 to axis of rotation 10 and may be calculated using the following formula:

$$\omega^2 = \frac{a_z}{r} \Rightarrow a^z = \left(\frac{2\cdot\pi}{t}\right)^2 \cdot r,$$

where the angular velocity is denoted by ω, the acceleration along the z axis is denoted by $a_z$, the distance of acceleration sensor 7 from axis of rotation 10 is denoted by r, and the time is denoted by t. A limiting value for a permissible acceleration of power tool 1 may be set on the basis of this formula. If the acceleration measured by acceleration sensor 7 exceeds the stipulated limiting value, then a reduction in the ease of operation is detected.

A further limiting value may be established by stipulating a time span, for which the limiting value of the acceleration must be exceeded before a reduction in the ease of operation is detected. The time span may be determined on the basis of a maximum rotational speed of drive unit 3 and the angle of rotation reasonable for a user. These data are stored, for example, in a memory 14 that is connected to control unit 6. If control unit 6 determines that one or more of the established limiting values are exceeded, then control unit 6 limits the electrical power output of drive unit 3 and/or decelerates drive unit 3 and/or cuts off the electrical power supply of drive unit 3.

Depending on the specific embodiment selected, a plurality of acceleration sensors 7 may also be provided, each acceleration sensor 7 acquiring a measuring signal for the x-axis and/or for the z-axis. In the specific embodiment described, the acquired measuring signals are filtered, for example, by a low-pass filter. Interference, as occurs, for example, in a percussion mode of the power tool, is suppressed by the low-pass filter. In this manner, the signal characteristic of the acquired measuring signal becomes more precise. A cutoff frequency of the low-pass filter may be individually adapted for each power tool. In particular, the cutoff frequency of the low-pass filter may be set as a function of the type of storage battery 4 used, in particular, as a function of the weight of storage battery 4.

Control unit 6 may execute the comparison of the transmitted measuring signals to the limiting values stored for them, itself. In addition, a separate evaluation circuit in analog or digital form may be provided, which executes the comparison of the acquired measuring signals to the established limiting values. In particular, a time characteristic of a measuring signal may also be specified as a limiting value. In addition, depending on the specific embodiment selected, acceleration sensor 7 may correspondingly have analog and/or digital circuits already, in order to compare the acquired measuring signal to the established limiting values. In this specific embodiment, acceleration sensor 7 transmits, for example, only one more information item to control unit 6, that a state of reduced ease of operation is present or not. Then, control unit 6 limits the power output of drive unit 3 further, for example, as a function of the existing information items regarding the state of reduced ease of operation.

For example, the storage batteries 4 used may differ in storage capacity, and consequently, in weight. For example, a storage battery 4 may have a weight of 1800 g or 1250 g or 330 g or 590 g. The power tool has different vibrational frequencies as a function of the weight of storage battery 4. Therefore, it is advantageous to consider the weight, that is, the type of storage battery 4, when selecting the filter characteristic for the filter. Control unit 6 selects different limiting values and/or different filter characteristics for filter 13, e.g., different cutoff frequencies, as a function of the type of storage battery, that is, as a function of the weight.

Power tool 1 may have an input unit 15, via which a type of storage battery 4 is input. In the simplest case, input unit 15 may take the form of a switch, which may be switched back and forth between two different weight types of the storage battery. For example, an information item about the weight of the type of storage battery 4 may be stored in memory 14. In addition, a detection circuit 16 may be provided on power tool 1, the detection circuit detecting the type of storage battery 4 and passing along a corresponding information item to control unit 6. In this case, an association of the type of storage battery 4 with a weight of storage battery 4 may also be stored in memory 14. Detection circuit 16 may detect, for example, a barcode of a storage battery 4, which contains the corresponding information for the type of storage battery 4. In addition, detection circuit 16 may be an electronic circuit, which reads a further memory 17 of storage battery 4; the type of storage battery 4 being stored in further memory 17.

With the aid of rotation-rate sensor 8, a rotation of power tool 1 is measured and passed on to control unit 6 via filter 13. Precise and reliable detection of an unchecked motion of the power tool, which constitutes a reduction in the ease of operation, is achieved by using an acceleration sensor and a rotation-rate sensor. For example, reduced ease of operation occurs when drill 2 jams during drilling and power tool 1 is rotated about axis of rotation 10 of drill 3. In an analogous manner, an abrasive disk of an angle grinder may also jam and cause the angle grinder to swivel.

Upon detection of an unchecked motion of the power tool, drive unit 3 is decelerated or switched off with the aid of control unit 6. With the aid of the described set-up, both very rapid and slow movements of the power tool may be detected and taken into account. Rapid movements of power tool 1 occur, for example, when a metric screw is tightened. The metric screw may be screwed in very easily. However, when the screw head rests on top, the screw jams abruptly. This may cause the power tool to accelerate in a direction opposite to the direction of rotation of the drive unit and in this manner, to execute an unchecked motion.

Slow movements of the power tool may occur, for example, when long wood screws are screwed in. When the long wood screws are screwed in, the locking torque builds up slowly and continuously. When the locking torque exceeds the strength of the user, the power tool starts to rotate slowly in a direction opposite to the direction of rotation of the drive unit. In this case, an unchecked motion may also be executed if the user does not switch off power tool 1 in a timely manner.

Figure 5:
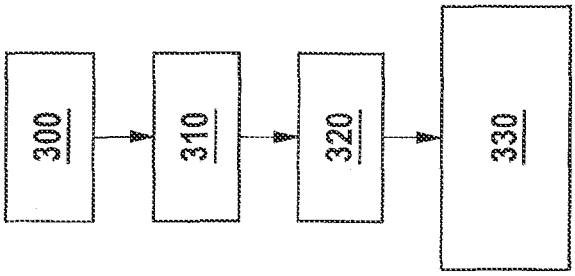
FIG. 5 shows a method sequence for evaluating a measuring signal of a rotation-rate sensor.
Figure 4:
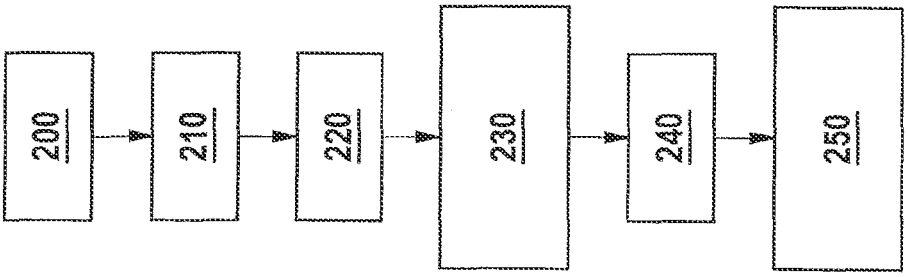
FIG. 4 shows a second method sequence for evaluating a measuring signal of an acceleration sensor.
Figure 3:
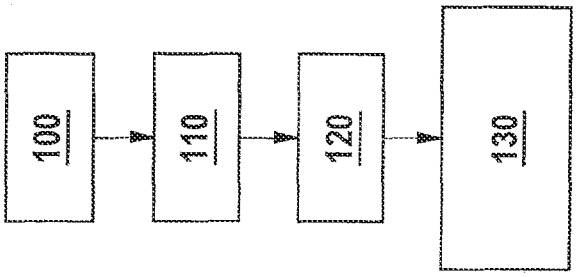
FIG. 3 shows a first method sequence for evaluating a measuring signal of an acceleration sensor.

In control unit 6, the measuring signals of acceleration sensor 7 and/or rotation-rate sensor 8 may be conditioned and processed in different ways, which are explained in light of the following FIGS. 3 through 5.

FIG. 3 shows a first method, in which at programming point 100, acceleration sensor 7 acquires a measuring signal for an acceleration along x-axis 11 and/or along z-axis 12. At a following programming point 110, the measuring signals are subjected to low-pass filtering by filter 13. In this example, the low-pass filter has a cutoff frequency of approximately 125 Hz. At programming point 120, the filtered measuring signal is subsequently subjected to high-pass filtering by filter 13. The high-pass filter has a cutoff frequency of approximately 1 Hz. The filtered signal is then transmitted to control unit 6. At programming point 130, control unit 6 checks the transmitted measuring signals for the x- and/or z-axis, using appropriate comparison values. For example, an acceleration of 3G for a time period of 20 ms is stored as a comparison value. Now, if control unit 6 determines that the measuring signal for the x-axis and/or the measuring signal for the z-axis indicates an acceleration of greater than 3G for a time period of longer than 20 ms, then a reduction in the ease of operation is detected and drive unit 3 is decelerated and/or switched off.

FIG. 4 shows a further method for detecting a reduction in the ease of operation. In this context, at programming point 200, a measuring signal for x-axis 11 is acquired by acceleration sensor 7. At a following programming point 210, the acquired measuring signal is subjected to low-pass filtering. Low-pass filter 13 may have a cutoff frequency of 125 Hz. At a succeeding programming point 220, the filtered measuring signal is subsequently integrated with respect to time. A rotational speed of power tool 1 results from this integration. The integrated measuring signal is then passed on to control unit 6. At a following programming point 230, control unit 6 executes a comparison to a fixed comparison value. In this context, a maximum rotational speed may be used as a comparison value, and in addition, a temporal duration for the duration of the exceeding of the maximum rotational speed may be used as a comparison value as a function of the specific embodiment selected. At programming point 230, if the control unit now determines that the comparison value for the rotational speed is exceeded or the time period for the maximum rotational speed is exceeded, then a state of poor ease of operation is detected by control unit 6, and drive unit 3 is decelerated and/or switched off.

In addition, in a succeeding method step 240, a repeated integration with respect to time may be carried out. In programming step 240, the repeated integration with respect to time yields a location or an angle of rotation for power tool 1. At a following programming point 250, a comparison to a comparison value is executed once more by control unit 6. In this case, a limiting value for a maximum angle of rotation is provided. At programming point 250, if the comparison reveals that the calculated angle of rotation is greater than the stored comparison angle of rotation, then a state of poor ease of operation is detected. By taking the angle of rotation into account, slow movements of the power tool, which could likewise result in a poor ease of operation, may also be detected.

FIG. 5 shows a further specific embodiment of the method, in which measuring signals of a rotation-rate sensor 8 are acquired and evaluated for detecting a state of poor ease of operation. At programming point 300, rotation-rate sensor 8 acquires a measuring signal for detecting a rate of rotation along, for example, x-axis 11. At a programming point 310, the acquired measuring signal is subjected to low-pass filtering by filter 13. The low-pass filter used may have, for example, a cutoff frequency of 250 Hz. At a following programming point 320, the filtered measuring signal is subjected to high-pass filtering. The high-pass filter used may have, for example, a cutoff frequency of 0.5 Hz. The filtered measuring signal of rotation-rate sensor 8 is subsequently supplied to control unit 6. At programming point 330, control unit 6 compares the filtered measuring signal to a specified threshold value. If the control unit determines that the acquired measuring signal exceeds the threshold value, then a state of poor ease of operation is detected. Depending on the specific embodiment selected, the control unit uses, in addition to the threshold value, a specified period of time.

If control unit 6 determines that the specified threshold value for the selected time period is exceeded, then a state of reduced ease of operation is detected. In response to detection of the reduced ease of operation, drive unit 3 is decelerated, and/or its power output is reduced, or it is switched off.

Figure 6:
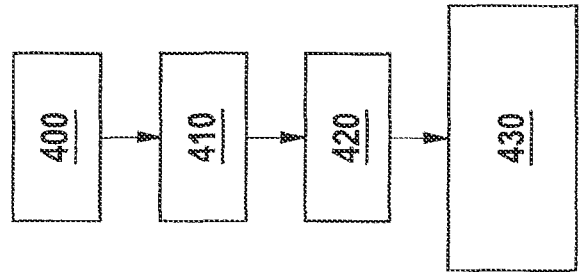
FIG. 6 shows a further method for evaluating a measuring signal of a rotation-rate sensor.

FIG. 6 shows a further specific embodiment for processing a measuring signal of rotation-rate sensor 8. At programming point 400, rotation-rate sensor 8 acquires a measuring signal for a rotation along x-axis 11. At a following programming point 410, the acquired measuring signal is low-pass filtered. Low-pass filter 13 may have a cutoff frequency of 250 Hz. At a succeeding programming point 420, the filtered measuring signal is subjected to integration with respect to time. In this manner, an angle of rotation is calculated. The integration may be carried out in control unit 6. At a following programming point 430, control unit 6 compares the calculated angle of rotation to a stored comparison value. If the calculated angle of rotation exceeds the stored comparison value, then a state of reduced ease of operation is detected. In response to detection of the reduced ease of operation, drive unit 3 is decelerated or switched off, or at least the electrical power output for the drive unit is reduced.

Of the methods described in FIGS. 3 through 6, at least two of the methods may be performed concurrently, for example. Depending on the specific embodiment selected, all of the methods may also be performed concurrently or in temporal succession. Using the methods described, several measuring signals and pieces of information about the motion of the power tool are available for reliably detecting an unchecked motion of a power tool 1. By this means, both rapid and slow movements may be evaluated, and, for example, a state of reduced ease of operation may be reliably detected.

In order to prevent possible instances of false activation due to intense vibrations during use in percussion drilling, for example, individual methods may also be combined with one another. Thus, for example, the power tool can only be switched off, when the method of FIG. 3 and the method of FIG. 5 result in the detection of a reduction in the ease of operation.

In addition to, or as an alternative to the rotation-rate sensor, a magnetic field sensor may also be used. The measured values of the magnetic field sensor may be evaluated in the same manner as the measured values of the rotation-rate sensor.

What is claimed is:

1. A power tool, comprising:

a tool unit;

a drive unit for the tool unit;

an operating device for activating the power tool;

a measuring device for measuring a motion of the power tool;

at least one filter for filtering at least one measured value of the measured motion;

a control unit configured to at least one of reduce a power output of the drive unit and decelerate the drive unit, when the filtered value of the measured motion reaches a specified comparison value;

a storage battery provided for supplying the drive unit with electrical energy; and a filter characteristic of the filter is a function of the weight of the storage battery, wherein the filter is at least one of a low-pass filter and a high-pass filter.

2. The power tool as recited in claim 1, wherein one of the following is provided in order to set the appropriate filter characteristic: (i) a detection circuit configured to detect a type of the storage battery, or (ii) an input unit for inputting information regarding the type of the storage battery.

3. A power tool comprising:

a tool unit;

a drive unit for the tool unit;

an operating device for activating the power tool;

a measuring device for measuring a motion of the power tool;

at least one filter for filtering at least one measured value of the measured motion; and a control unit configured to at least one of reduce a power output of the drive unit and decelerate the drive unit, when the filtered value of the measured motion reaches a specified comparison value, wherein the filter is at least one of a low-pass filter and a high-pass filter, wherein the measuring device includes at least one of an acceleration sensor and a rotation-rate sensor; and at least one of (i) a first filter having a first filter characteristic is provided for filtering the measuring signal of the acceleration sensor, and (ii) a second filter having a second filter characteristic is provided for filtering the measuring signal of the rotation-rate sensor.

4. The power tool as recited in claim 3, wherein an integration unit is provided for integrating at least one of the filtered measuring signal of the acceleration sensor and the filtered measuring signal of the rotation-rate sensor, and wherein the control unit is configured to use the at least one of the integrated measuring signal of the acceleration sensor and the integrated measuring signal of the rotation-rate sensor for detecting a reduction in an ease of operation.

5. The power tool as recited in claim 3, wherein the control unit is configured to detect a reduction in an ease of operation when at least one of the measuring signal of the acceleration sensor and the measuring signal of the rotation-rate sensor reaches a respective specified value.

6. The power tool as recited in claim 4, wherein the control unit is configured to detect a reduction in an ease of operation when the at least one of the integrated measuring signal of the acceleration sensor and the integrated measuring signal of the rotation-rate sensor reaches a respective specified value.

7. The power tool as recited in claim 3, wherein the acceleration sensor is provided for monitoring the motion of the power tool in at least two moving directions of the power tool perpendicular to one another, and wherein the control unit is configured to use the monitored motion of the power tool in the two moving directions for measuring the motion of the power tool.

8. The power tool as recited in claim 3, wherein the specified comparison value is at least one of: a limiting value; a limiting value and a period of time; a characteristic curve function of the motion versus time; and a characteristic curve function of the motion versus a distance.

9. A method as for operating a power tool having a drive unit for a tool, comprising:

measuring a motion of the power tool using at least one measuring signal;

filtering the at least one measuring signal; and at least one of (i) reducing a power output of the drive unit and (ii) decelerating the drive unit, when the filtered measuring signal reaches a limiting value which corresponds to a reduction in an ease of operation, wherein the drive unit is supplied with electrical energy by a storage battery, and the measuring signal is filtered using a filter characteristic which varies as a function of a weight of the storage battery.

10. The method as recited in claim 9, wherein one of (i) the type of storage battery is detected, or (ii) information regarding the type of storage battery is read in or input, in order to set the appropriate characteristic for the filtering.

11. The method as recited in claim 9, wherein at least one of an acceleration and a rate of rotation of the power tool is measured, the measuring signal of the acceleration is filtered at a first filter characteristic, and the measuring signal of the rate of rotation is filtered at a second filter characteristic.

12. The method as recited in claim 11, wherein the at least one of the filtered measuring signal of the acceleration and the filtered measuring signal of the rate of rotation is integrated with respect to time, and the at least one of the integrated measuring signal of the acceleration and the integrated measuring signal of the rate of rotation is used for detecting a state of reduced ease of operation.

* * * * *